US007707685B2

(12) United States Patent
Pongrac

(10) Patent No.: US 7,707,685 B2
(45) Date of Patent: May 4, 2010

(54) CARPET EDGE SECURING STRIPS

(76) Inventor: John Leonard Pongrac, 2594 E. Morningstar Ct., Hayden, ID (US) 83835

( * ) Notice: Subject to any disclaimer, the term of this patent is extended or adjusted under 35 U.S.C. 154(b) by 267 days.

(21) Appl. No.: 11/821,193

(22) Filed: Jun. 21, 2007

(65) Prior Publication Data

US 2008/0313850 A1 Dec. 25, 2008

(51) Int. Cl.
*A47G 27/04* (2006.01)

(52) U.S. Cl. ..... 16/16

(58) Field of Classification Search ..... 16/16, 16/17.1

See application file for complete search history.

(56) References Cited

U.S. PATENT DOCUMENTS

| | | | | |
|---|---|---|---|---|
| 2,051,191 | A | 8/1936 | Watson | |
| 2,211,574 | A | 8/1940 | McNicholas | |
| 2,554,674 | A * | 5/1951 | Karas | 16/16 |
| 2,611,918 | A | 9/1952 | Jaasund | |
| 2,634,453 | A | 4/1953 | Brownstein | |
| 2,677,145 | A * | 5/1954 | Adams | 16/16 |
| 2,928,115 | A | 3/1960 | Hill | |
| 3,008,173 | A | 11/1961 | Goss | |
| 3,144,678 | A * | 8/1964 | La Casse | 16/16 |
| 3,208,096 | A * | 9/1965 | Linsky | 16/16 |
| 3,254,361 | A * | 6/1966 | Craven et al. | 16/16 |
| 3,395,420 | A * | 8/1968 | Hill et al. | 16/16 |
| 3,528,122 | A * | 9/1970 | Smith et al. | 16/16 |
| 3,670,360 | A * | 6/1972 | Hill | 16/16 |
| 3,683,738 | A | 8/1972 | Kyriakos | |
| 4,069,542 | A | 1/1978 | Carder | |
| 4,653,138 | A * | 3/1987 | Carder | 16/4 |
| 4,837,889 | A * | 6/1989 | Saotome | 16/4 |
| 4,970,754 | A | 11/1990 | Anderson et al. | |
| 5,500,980 | A | 3/1996 | Morrow et al. | |
| 5,661,874 | A * | 9/1997 | Latour | 16/4 |
| 5,956,804 | A | 9/1999 | Dunne | |
| D417,389 | S | 12/1999 | Rhoads | |
| 6,038,733 | A * | 3/2000 | Carder et al. | 16/16 |
| 6,553,616 | B2 * | 4/2003 | Johnson | 16/16 |
| 7,392,626 | B2 * | 7/2008 | Farrend | 52/273 |

* cited by examiner

*Primary Examiner*—Victor Batson
*Assistant Examiner*—Michael Lee
(74) *Attorney, Agent, or Firm*—Gene Scott; Patent Law & Venture Group

(57) ABSTRACT

A carpet attachment fixture functions as a common tack strip for securing a carpet edge in place and also as a terminal decorative strip mating with a base board molding, a floor surface, and a raised floor surface. Elements of the fixture are flexible so as to flex in admitting the carpet edge between two opposing edges while compressively gripping the carpet edge so inserted. In one embodiment, a common tack strip is married to a further element, while in a second embodiment, a monolithic unit is molded which provides all of the advantages of the compound version.

2 Claims, 4 Drawing Sheets

CARPET EDGE SECURING STRIPS

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

BACKGROUND OF THE INVENTION

1. Field of the Present Disclosure

This disclosure relates generally to strip type fastening devices and especially those used for securing the edges of carpets. More particularly this disclosure refers to an improved family of such fixtures that are less expensive and easier to use and which provide enhanced results.

2. Description of Related Art Including Information Disclosed Under 37 CFR 1.97 and 1.98

Rhoads, U.S. D417,389, discloses an ornamental design for a tacking strip.

Watson, U.S. Pat. No. 2,051,191, discloses a concealed carpet fastener composed of an elongated metal strip bent longitudinally to constitute a fastener having two parallel sides, the lower side being perforated to permit permanent attachment of the fastener to the floor, and the upper side being provided with teeth or projections over the free edge of which the upper side the margin of the fabric is adapted to be folded, and which teeth or projections are adapted to engage the fabric at its under side, and retain the same against displacement of its aligned margin when the upper side of the fastener is pressed down upon the folded margin of the fabric to clamp the same.

McNicholas, U.S. Pat. No. 2,211,574, discloses a device comprising, a strip of flexible material formed with a lengthwise extending pocket and a coextending side section for abutting engagement with an upright surface, the strip provided with a lower face having adhesive material thereon for securing the strip to the surface of a floor adjacent the upright surface, a filler medium within the pocket, and anchoring elements extending through the pocket and the medium above the strip for securing carpets to the strip in adjusted position over the floor.

Karas, U.S. Pat. No. 2,554,674, discloses a concealed carpet fastener comprising an elongated metal strip having a bend intermediate the edges to provide upper and lower sections, the lower section having apertures therein to receive securing means whereby the fastener may be secured to the floor and the upper section having a smooth uninterrupted free edge about which the margin of the carpet may be folded, the upper section adapted to be located above the floor to receive the margin of the carpet there under, the upper section between the edge and bend being provided with means extending above the upper surface thereof for piercing the underside of the carpet to hold the carpet against relative movement back from the edge.

Jaasund, U.S. Pat. No. 2,611,918, discloses a combined carpet fastener and binder which comprises a boundary strip to be nailed to the floor co-extensive with one edge of the carpet, an elongated bendable U-shaped gripper element having opposed sets of teeth to engage the edge of the carpet, and flexible means supporting the gripper element above the binder strip, the boundary strip being disposed parallel to and at predetermined distance from an adjacent wallboard to provide a recess into which the gripping element and its flexible supporting means may be reversely bent after the carpet edge has been gripped whereby the carpet is fastened and stretched taut over the boundary strip. Brownstein, U.S. Pat. No. 2,634,453, discloses a carpet-securing device an elongated body member comprising two joined adjacent sections in angular relation, one of the sections sloping downwardly in one direction and the other section sloping downwardly in the opposite direction, a plurality of prongs in longitudinally spaced relation along the juncture of the two sections, the prongs being formed from the material from one of the sections and extending upwardly from the other of the sections in a common plane therewith, and a base portion integral with each of the sections and adapted to rest upon a floor surface, the base portions being disposed on opposite sides of the prongs and in laterally spaced relation therewith, whereby the prongs will be held in stable operative position.

Hill, U.S. Pat. No. 2,928,115, discloses a carpet gripper suitable for installation in both long and short strips, the combination of: a long and narrow strip of a relatively light colored material, the strip having an upper surface provided with a longitudinal band adjacent one edge and of a relatively dark color, the upper surface having a shallow groove extending longitudinally there along parallel to an edge of the strip whereby installation nails may be driven through the strip at the groove at any point along the strip; a plurality of spaced nails projecting into the strip through the groove and extending there above, the nails being of a dark color contrasting with the color of the material and a plurality of carpet hooking means having pointed ends projecting upward from the strip.

Goss et al., U.S. Pat. No. 3,008,173, discloses a carpet gripper, the combination of: a long, narrow strip of wood having upper and lower sides and outer and inner edges; the lower side of the strip being engagable with a floor and the outer edge thereof being engagable by a down turned edge of carpeting overlying the upper side of the strip; an outer, upper integral flange extending longitudinally of the strip and projecting laterally outwardly from the outer edge thereof and having an upper surface forming an outward extension of the upper side of the strip; an inner, lower integral flange extending longitudinally of the strip and projecting laterally inwardly from the inner edge thereof and having a lower surface forming an inward extension of the lower side of the strip; the upper flange projecting laterally outwardly from the outer edge of the strip and the lower flange projecting laterally inwardly from the inner edge of the strip substantially equal distances so that the strip is substantially symmetrical in cross section and a plurality of carpet hooking elements carried by the strip and projecting upwardly above the upper side of the strip and inclined outwardly toward the outer edge of the strip to secure carpeting overlying the upper side of the strip.

Kyriakos, U.S. Pat. No. 3,683,738. discloses a tack strip of the type formed from a length of flexible, non-resilient metal longitudinally folded to provide first and second angularly disposed flanges, both serrated to provide a series of tabs separated by notches with the first flange to underlie a margin of upholstery material and the second flange provided with a series of projections overlying the first flange and constituting anchoring tacks when the second flange is folded over the driven flat against the material. The invention provides each tab of the first flange with a hole positioned always to receive one projection and the notches of the first flange to receive the other projections unless the strip is so bent as to close them.

Carder, U.S. Pat. No. 4,069,542, discloses carpet securing strips where the strips are designed to be manufactured from relatively thin or light gauge metal or plastic; each having an elongate base section designed to be secured by nails and/or adhesive to a floor, and having an offset carpet-gripping section which in one embodiment is designed in use to be hammered or bent downwardly relative to the base section and over the edge of a section of carpeting to secure the latter in place, and which in a second embodiment has formed in its longitudinal edge a plurality of spaced teeth which imbed in the bottom of a carpet to hold its edge in place. In the second embodiment a plurality of longitudinally spaced scallops or dimples are formed in the strip to increase its structural rigidity; and in each embodiment adhesive strips are used to help secure the carpeting to the strips.

Saotome, U.S. Pat. No. 4,837,889, discloses a carpet retention device or anchor that includes a flat, thin, floor engaging flange having spaced-apart openings for reception of nails to anchor the retention device to the underlying floor. A thin web extends upwardly from one edge of the base flange to a height equal to or less than the height of the carpet pad. A plurality of tacks or pointed projections extend transversely and slightly downwardly from the upper edge of web to engage into the underside of an overlying carpet.

Anderson et al, U.S. Pat. No. 4,970,754 discloses an improved synthetic resinous formulation utilized to form a substrate for retention of carpet while securing tack and pre-nail elements in strip form, and with the pre-nails being adapted to secure the substrate in place along the edge surfaces of the floor and with the tack elements being adapted to retain the edge portions of a carpet in place thereon. The substrate is characterized in that it is formed essentially of a filled polyurethane compound which possesses unusual mechanical properties particularly desirable in the formation of carpet retaining strips. These properties include the flexibility to permit the strip to conform to an irregular floor surface, and furthermore can be readily cut and notched to allow it to be bent to conform to an inside or outside corner. Because of the excellent plastic memory, the carpet retaining tacks are held at a desired angle even when subjected to substantial lateral tension caused by the stretched in-place carpet. The formulation of the polyurethane includes a prepolymer comprising a polyetherpolyol (35%-40%), a cross-linking agent (15%-20%), a filler consisting essentially of inert ingredients (10%-36%), a catalyst (10%-15%) and a chemical blowing or frothing agent (mechanical) (3%-5%), and wherein methylene di-isocyanate is added to the prepolymer components blend (component B), the prepolymer consisting of 80% of the blend, balance methylene di-isocyanate (component A) (20%).

Morrow et al, U.S. Pat. No. 5,500,980 discloses a carpet securement that includes a polymeric body with a longitudinally extending groove in its bottom surface. Tacks or other fasteners protrude upwardly through the body. The tack heads or other drive elements of the fasteners may be lodged within the groove and serve as a bearing element to help support that portion of the body bridging the groove. The body may also be provided with a downwardly projecting rib-like support rail inside the groove to help support the body. A groove minimizes the weight of a polymer incorporated in the securement body and further permits flush seating of the fasteners without localized overstressing of the polymer. In an extrusion process useful in making the body or other polymeric elements, sizing dies are provided with devices for maintaining a fluid film between an extrudate passed through the die and the contact surfaces of the die itself.

Latour, U.S. Pat. No. 5,661,874, discloses a carpet fastening system in which a fastening strip is affixed to the back-side of the wall board or the wall baseboard, preferably with the wall engagement portion being substantially flat, presenting either a flat, face-to-face, extended surface interface with the back-side of the wall or at least preferably a continuous or at least substantially extended edge in engagement with the back-side, bottom edge of the wall baseboard. For ease in installation, the fastening strips may be installed either at the same time as the baseboards are installed or even when the wall boards are being installed. As a result of engaging the back-side of the wall the fastening strips are firmly affixed to the wall and provide secure, strong affixation to the wall, securely anchoring the strips and hence the carpet, preventing any migration of the carpet during its typically expected life-time and longer. The embodiments are described, each of which engage and interlock with the backside of the wall, either in a sandwich arrangement or an angled back straight edge engagement with a lip formed between the wall board and the baseboard. However, in all cases, when a force is applied to the fastening strip in a direction tending to pull it away from the wall, the force causes the movement resistance engagement of the strip to proportionately increase due to the interfacing with the back-side of the wall.

Dunne, U.S. Pat. No. 5,956,804 discloses an improved carpet tack strip formed from synthetic chemical and natural materials which include a selective amount of a polyethylene material of between 40% to 60% by weight, which is mixed with a selected amount of polypropylene material having about 1% to 10% by weight and including therein a fine powdered wood material having a selected amount of between 60% to about 40% by weight, wherein the mixture thereof is extruded from an extruding apparatus, thereby producing a continuous elongated homogeneous plastic strip that when cooled is cut in predetermined lengths.

The related art described above discloses a very wide variety of carpet clamping and securing devices. The present disclosure however distinguishes over the prior art providing heretofore unknown advantages as described in the following summary and detailed description.

BRIEF SUMMARY OF THE INVENTION

This disclosure teaches certain benefits in construction and use which give rise to the objectives described below.

So-called wall-to-wall carpets are broadly used in living and work spaces. Most of these carpets are held in place by tack strips, wooden strips that are nailed or otherwise fastened to a floor in a position running parallel to baseboards and spaced apart from such baseboards. The edges of the carpeting are engaged with tacks protruding upwardly from the tack strips and the free edge of the carpet either is hidden under a baseboard or remains unsecured to curl up or otherwise appear unsightly. When baseboards are already in place so that the carpet edge is not able to be hidden thereunder, the conventional tack strip falls short of providing a solution. The prior art described above provides several solutions to this problem. In other installations, carpets terminate at uncarpeted surfaces which may be set onto continuations of the carpeted surface but provide a slightly elevated surface (thickness of stone, tile or other floor surfacing).

A carpet attachment fixture has a first elongated strip preferably a common tack strip for securing the edges of a carpet in place. The tack strip is engaged with, or separated from, but used with, a second strip which has a leg secured to, or in contact with, the bottom surface of the first strip and resting in contact with a floor surface, a further leg abutting the side surface of the first strip, and a still further leg extending away from the first strip, with a surface of the leg positioned approximately coplanar with the top surface of the first strip and terminating at an edge configured for gripping the carpet. An edge of the carpet is engaged with the tack strip and is folded around the edge which holds the carpet by compressive forces. In a further embodiment all of the features of the compound assembly are combined in a single integrally molded part.

A primary objective inherent in the above described apparatus and method of use is to provide advantages not taught by the prior art.

Another objective is to provide a fixture for securing the peripheral portions of a carpet while securing the edge of the carpet.

A further objective is to provide such a fixture that is able to additionally enhance the interface between carpeted areas and other floor areas.

A still further objective is to provide such a fixture that clamps the edges of a carpet between sharp edges across a gap.

A yet further objective is to provide such a fixture that is able to be fabricated by an extrusion process.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

Figure 3:
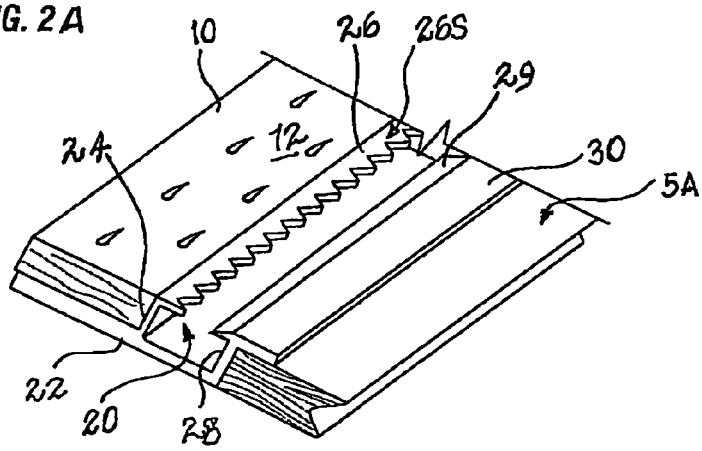
Figure 6:
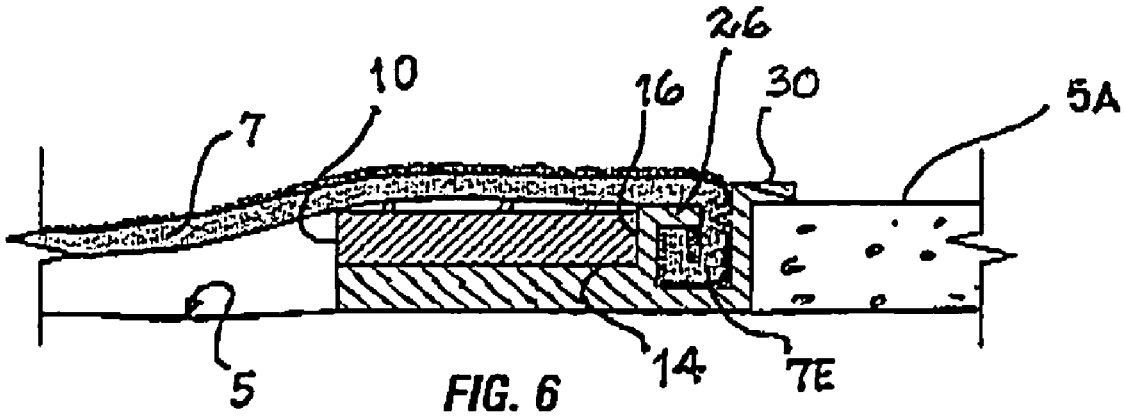
Figure 7:
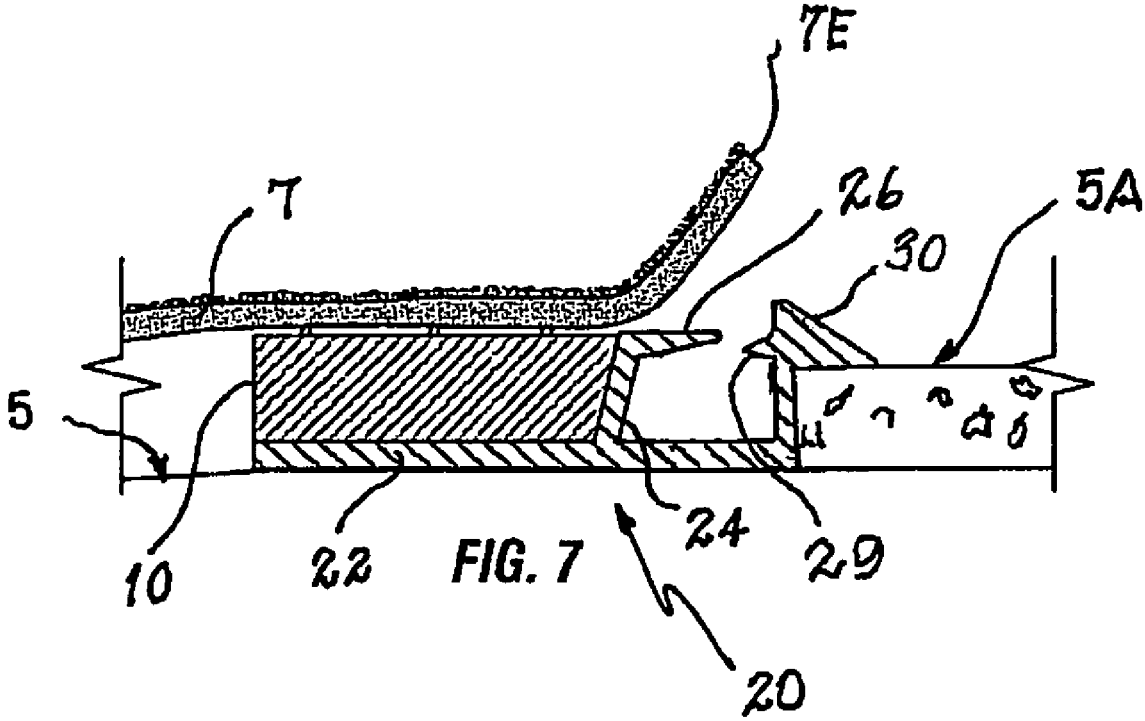
Figure 8:
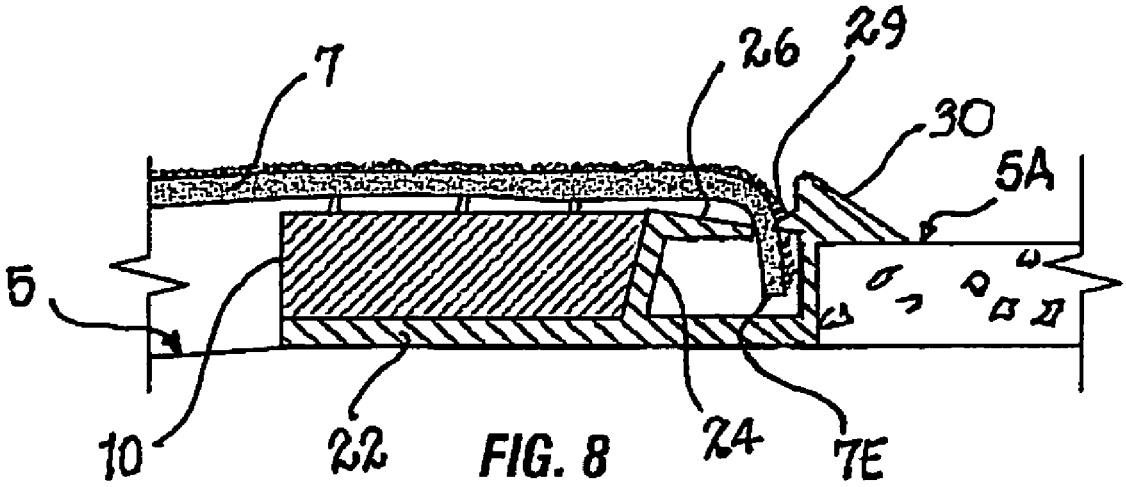
Figure 9:
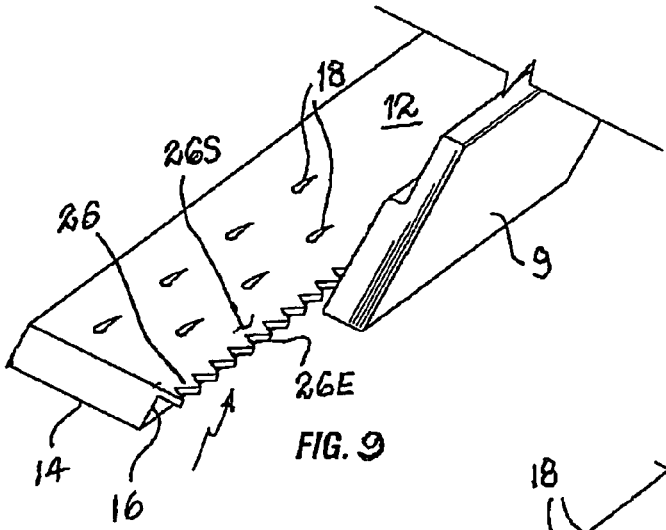
Figure 10A:
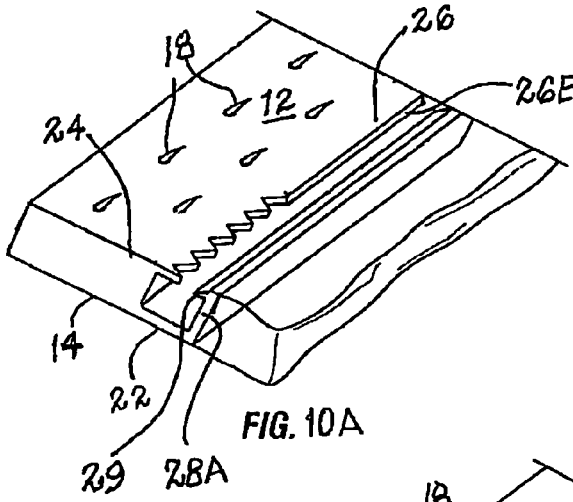
Figure 10B:
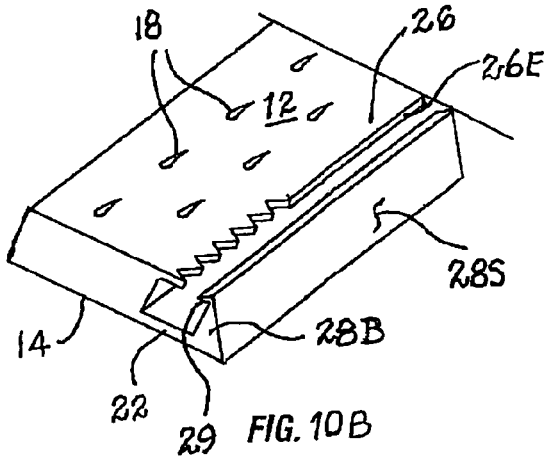
Figure 11:
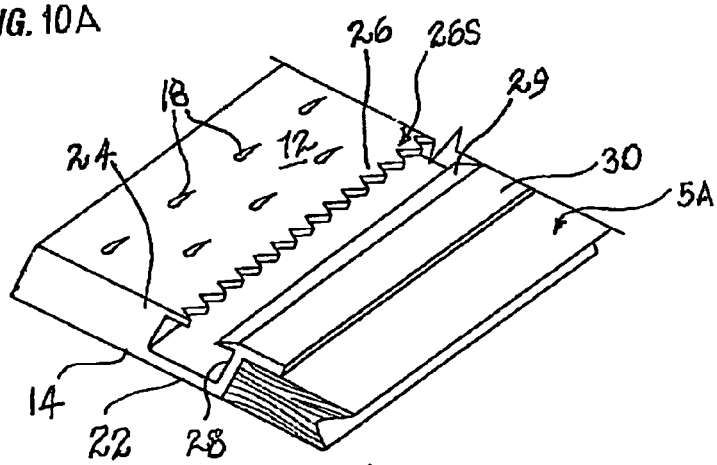

FIGS. 7 and 8 are cross-sectional views of an embodiment similar to that of FIGS. 3 and 6 demonstrating the method of the invention of inserting and securing a carpet edge; and FIG. 9 a perspective view of a prior an device that is used with the present invention and preferably is made an integral part thereof; and FIGS. 10A, 10B and 11 are perspective views of the presently described apparatus in a fifth, sixth, and seventh embodiments respectively.

The drawings have been made with exaggerated features, such as the carpet base being shown rather compressed, the knap of the carpet shown quite small and the features of the securing fixtures shown slightly enlarged. These changes enable one to clearly view the details of the several embodiments.

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it must be understood that what is illustrated is set forth only for the purposes of example and that it should not be taken as a limitation in the scope of the present apparatus and method of use.

Described now in detail are fixtures for securing an edge 7E of a carpet 7 to a floor surface 5. These fixtures are made in lengths of between 4 and 12 feet and are uniform in cross-section over their full length. The drawing figures show only one end of the fixtures. The several versions described here are based on an assembly of either two elements as a dual fixture, or a single element fixture. In both the dual element fixture and the single element fixture several corresponding versions are described. FIGS. 1, 2A, 23, and 43-8 refer to versions of the dual element fixture, while FIGS. 9, 10A, 10B and 11 refer to versions of the single element fixture. FIGS. 4-8 relate to the use of both dual and single element versions.

The present apparatus solves the problem of terminating a carpet edge 7E when the carpet edge terminates adjacent to a base board 9, or a raised floor surface 5A or merely the continuation of the floor surface 5 which the fixture and carpet are laid or installed upon.

Dual Element Fixtures

In versions of the dual element fixture shown in FIGS. 1, 2A, 2B and 3, the apparatus comprises a first elongated strip 10 which is preferably made of plastic or wood and has a top surface 12, a bottom surface 14, and a side surface 16. Strip 10 is well known as a "tack strip" and is widely used in securing carpet edges. The side surface 16 extends between the top surface 12 and the bottom surface 14 and a plurality of tacks 18 protrude upwardly extending from the top surface 12 at an angle directed toward the side surface 16. This first strip 10 is used in combination in each of the embodiments described in the dual element fixtures.

Figure 1:
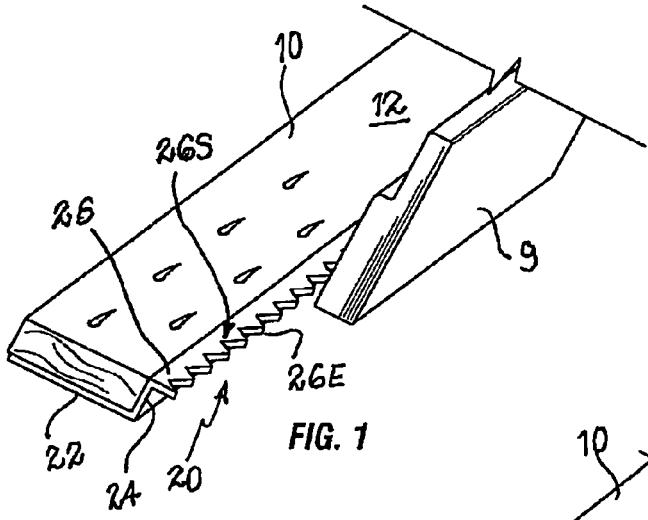
FIGS. 1, 2A, 2B and 3 are perspective views of the presently described apparatus in a first, second, third and fourth embodiments respectively.
Figure 2A:
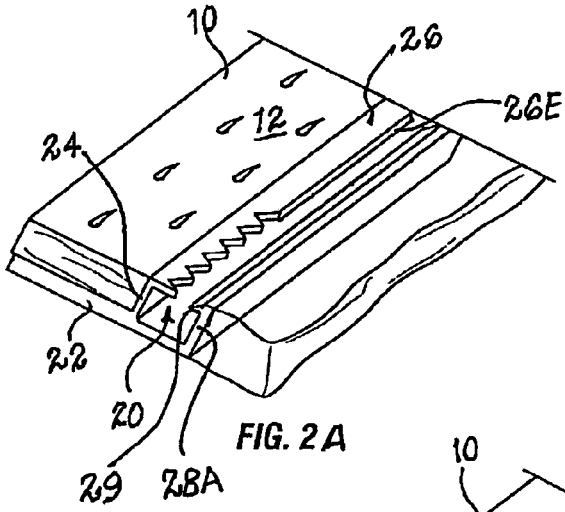
Figure 2B:
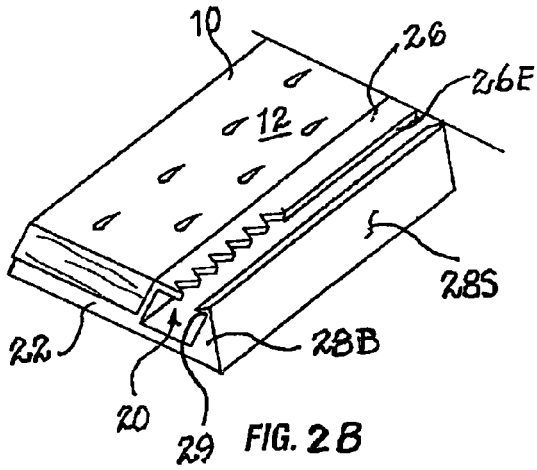
Figure 4:
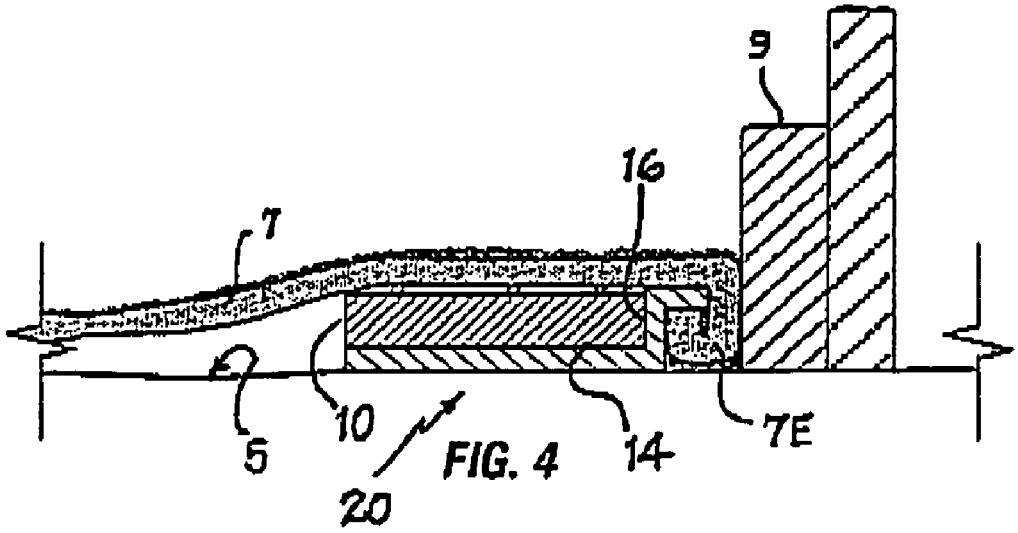
FIGS. 4-6 are vertical sectional views of FIGS. 1, 2A and 3 thereof respectively, showing the placement and securement of a carpet edge.

For terminating a carpet 7 adjacent to a baseboard 9, a second elongated strip 20 is made up, preferably from sheet metal or plastic, and has longitudinal bends forming what are referred to herein as "legs," as will be understood in conjunction with the figures. The legs are continuous longitudinal elements and are integrally formed defining strip 20. In FIGS. 1 and 4, strip 20 has a horizontal A-leg 22 which is preferably secured to the bottom surface 14 of the first strip 10 and rests, or is joined in contact with a floor surface 5 as shown in FIG. 4. A B-leg 24 abuts the side surface 16 of the first strip 10 in an essentially vertical or near vertical attitude, and a C-leg 26 extends in a horizontal direction away from the first strip 10, preferably with a surface 26S of the C-leg 26 positioned approximately coplanar with the top surface 12 of the first strip 10. The C-leg 26 terminates at an edge 26E configured either as a flat planar vertical surface as shown in FIGS. 2A and 2B, or as a series of teeth as best shown also in FIGS. 2A and 2B, where a portion of the edge 26E is shown as a straight edge and a portion is shown as a series of teeth. In practice the edge 26E may be formed as one or the other or may have portions of both. Alternately, the edge 26E may be pointed as shown in FIGS. 7 and 8. In use, as shown in FIG. 4, the carpet edge 7E is inserted between edge 26E and the baseboard 9 and is held in place by compressive forces exerted by the C-leg 26 which presses carpet 7 against the baseboard 9.

Figure 5:
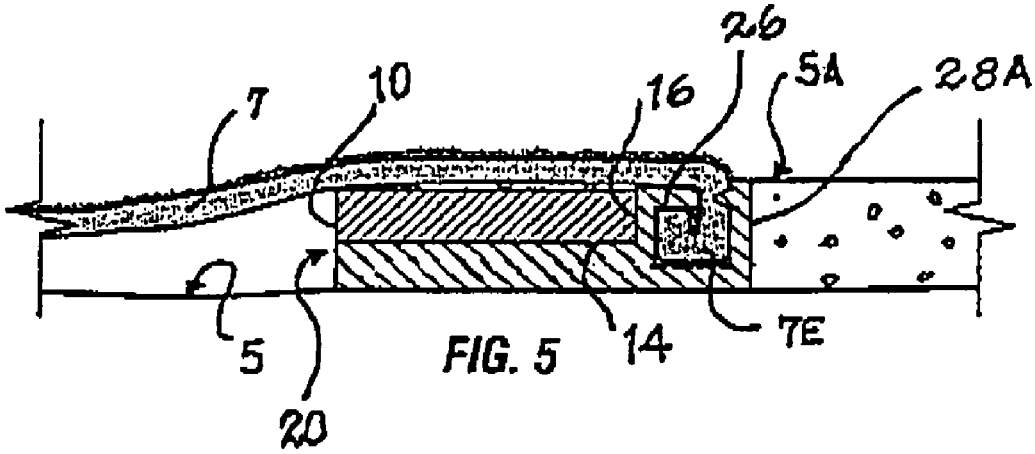

In two further versions shown in FIGS. 2A and 2B, the A-leg 22 is extended to the right in the figures and terminates at a D-leg 28A or 28B which is preferably in a vertical attitude spaced apart from the C-leg 26 leaving a gap between them. D-leg 28A is configured for abutting a raised floor having a surface 5A as shown in FIG. 2A, while D-leg 28B is configured with a slanted surface 28S which slopes downward to meet floor surface 5. The later approach is used when there is no change in floor surface elevation at the edge of the carpet 7. Both D-leg 28A as well as 28B provide a pointed ridge 29 directed toward and opposite C-leg 26 to form a gap therebetween. Preferably C-leg 26 is flexible so that when carpet edge 7E is inserted between C-leg 26 and ridge 29, a compressive force is exerted onto carpet 7 so as to secure it within the gap. Please see FIGS. 5, 6 and 8. It is noted that carpet 7 need not be curled as shown in FIGS. 4-6.

In a still further version of the dual element fixtures, as shown in FIGS. 3 and 6-8 an E-leg 30 extends from D-leg 28 in a direction away from strip 10 and is positioned for covering the edge of the raised floor surface 5A. E-leg 30 may provide a flat horizontal top surface as shown in FIGS. 3 and 6, or may have a slanted surface as shown in FIGS. 7 and 8.

As shown, the edge 7E of the carpet is tucked into the space between the edge 26E and the ridge 29 and the carpet 7 is hooked onto the tacks 18. The tacks 18 and the teeth or pointed aspect of the edge 26E work together to prevent the carpet 7 from pulling away from the fastener strips 10 and 20, and the edge 26E maintains the tucked position of the carpet edge 7E. The strips 10 and 20 may be secured to the floor using any well known means including nails driven through the strip and then into the floor surface.

Single Element Fixtures

In versions of the single element fixture shown in FIGS. 9, 10A, 10B and 11, the apparatus is preferably an extruded, or injection molded monolithic part made of plastic. As shown these fixtures have the previously defined top surface 12, a bottom surface 14, and a side surface 16. The side surface 16 extends between the top surface 12 and the bottom surface 14 and a plurality of tacks 18 protrude upwardly extending from the top surface 12 at an angle directed toward the side surface 16. Tacks 18 may be molded as integral elements in an injection molding process, or may be inserted after the extrusion molding process.

For terminating a carpet 7 adjacent to a baseboard 9, the C-leg 26 extends in a horizontal direction away from side surface 16, preferably with the surface 26S of the C-leg 26 positioned approximately coplanar with the top surface 12. The C-leg 26 terminates at an edge 26E configured either as a flat planar vertical surface or as a series of teeth as best shown also in FIGS. 10A and 10B. In practice the edge 26E may be formed as one or the other or may have portions of both depending on the fabrication technique used. Alternately, the edge 26E may be pointed as shown in FIGS. 7 and 8. In use, the carpet edge 7E is inserted between edge 26E and the baseboard 9 and is held in place by compressive forces exerted by the C-leg 26 which presses carpet 7 against the baseboard 9 as shown in FIG. 4.

In the versions shown in FIGS. 10A and 10B, a modified A-leg 22 extends to the right in the figures and terminates at a D-leg 28A or 28B which are preferably in a vertical attitude spaced apart from the edge 26E leaving a gap between them. D-leg 28A is configured for abutting a raised floor having a surface 5A as shown in FIG. 1, while D-leg 28B is configured with a slanted surface 28S which joins floor surface 5. Both D-leg 28A as well as 28B provide a pointed ridge 29 directed toward and opposite edge 26E forming a gap therebetween. Preferably C-leg 26 is flexible so that when carpet edge 7E is inserted between C-leg 26 and ridge 29, a compressive force is exerted onto carpet 7 so as to secure it within the gap as previously described.

In a still further version, as shown in FIG. 11, an E-leg 30 extends from D-leg 28 and is positioned for covering the edge of the raised floor surface 5A.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A fixture apparatus for securing an edge of a carpet to a horizontal floor surface; the apparatus comprising: a first elongated strip having an essentially horizontal top surface, an essentially horizontal bottom surface, and an essentially vertical side surface, the side surface extending between the top surface and the bottom surface; and a second elongated strip having:

a) an essentially horizontal A-leg abutting the bottom surface of the first strip, b) an essentially vertical B-leg integral with the A-leg and abutting the side surface of the first strip, and c) an essentially horizontal, flexible, C-leg integral with the B-leg and extending away therefrom by at least a thickness of the carpet, a surface of the C-leg approximately coplanar with the top surface of the first strip, whereby with the carpet edge inserted between the B-Leg and an essentially vertical surface proximal the C-leg, the carpet flexes the C-leg downwardly thereby jamming the carpet in place, d) an essentially vertical D-leg extending upwardly from the A-leg and spaced apart from the B-leg wherein with the carpet edge inserted between the B-leg and the D-leg the carpet flexes the C-leg thereby jamming the carpet in place.

2. A combination apparatus for installation on a floor surface, the apparatus comprising:

a carpet having a carpet edge, a first elongated strip having an essentially horizontal top surface, an essentially horizontal bottom surface, and an essentially vertical side surface; and a second elongated strip having:

i) an essentially horizontal A-leg abutting the bottom surface of the first elongated strip, ii) an essentially vertical B-leg integral with the A-leg and abutting the side surface of the first elongated strip, and iii) an essentially horizontal, flexible, C-leg integral with the B-leg and extending away therefrom by at least a thickness of the carpet, a surface of the C-leg approximately coplanar with the top surface of the first elongated strip; whereby the carpet edge is able to be pressed between the B-leg and a vertical surface thereby flexing the C-leg downwardly so as to jam the carpet in place, iv) an essentially vertical D-leg integral with the A-leg and spaced apart from the B-leg; the carpet edge inserted between the B-leg and the D-leg with the C-leg flexed downwardly thereby jamming the carpet in place.

* * * * *

UNITED STATES PATENT AND TRADEMARK OFFICE

CERTIFICATE OF CORRECTION

PATENT NO. : 7,707,685 B2
APPLICATION NO. : 11/821193
DATED : May 4, 2010
INVENTOR(S) : John Leonard Pongrac It is certified that error appears in the above-identified patent and that said Letters Patent is hereby corrected as shown below:

error: Col. 5, Line 54: FIG.9 a perspective view of a prior an device that is used...

correction: Col. 5, Line 54: FIG. 9 a perspective view of a prior art device that is used...

Signed and Sealed this

Fifteenth Day of June, 2010

David J. Kappos

David J. Kappos
*Director of the United States Patent and Trademark Office*